US005424157A

United States Patent [19]

Miyamoto et al.

[11] Patent Number: 5,424,157

[45] Date of Patent: Jun. 13, 1995

[54] ELECTROPHOTOSENSITIVE MATERIAL CONTAINING DISAZO COMPOUND AS CHARGE-GENERATING AGENT

[75] Inventors: Eiichi Miyamoto; Yasufumi Mizuta, both of Osaka, Japan

[73] Assignee: Mita Industrial Co., Ltd., Osaka, Japan

[21] Appl. No.: 158,783

[22] Filed: Dec. 1, 1993

[30] Foreign Application Priority Data

Dec. 1, 1992 [JP] Japan ..... 4-322124

[51] Int. Cl.[6] ..... G03G 5/06

[52] U.S. Cl. ..... 430/73; 430/76; 430/83

[58] Field of Search ..... 430/59, 58, 70, 71, 430/72, 74, 76, 78

[56] References Cited

U.S. PATENT DOCUMENTS 4,788,119 11/1988 Yamashita et al. ..... 430/58
5,132,189 7/1992 Kuroda et al. ..... 430/73
5,168,026 12/1992 Miyamoto ..... 430/73

*Primary Examiner*—John Goodrow
*Attorney, Agent, or Firm*—Sherman and Shalloway

[57] ABSTRACT

An electrophotosensitive material containing, as a charge-generating agent, a compound represented by the following general formula (1), wherein Cp is an azo coupling component, Y is a divalent organic group containing at least one aromatic ring or heterocyclic ring, R1 and R8 are alkyl groups or halogen atoms, respectively, and R2 and R4 are alkyl groups, halogen atoms or hydrogen atoms, respectively. The charge-generating agent used here remains chemically stable and exhibits excellent recurring property and charge-forming efficiency.

6 Claims, 3 Drawing Sheets

ELECTROPHOTOSENSITIVE MATERIAL CONTAINING DISAZO COMPOUND AS CHARGE-GENERATING AGENT

BACKGROUND OF THE INVENTION

1. Field of the Invention

The present invention relates to an electrophotosensitive material used for electrophotographic copying, laser printer and the like. More specifically, the invention relates to an electrophotosensitive material containing a novel charge-generating agent and having high sensitivity and excellent recurring property.

2. Description of the Prior Art

It has long been known that a disazo pigment is effectively used as a photoconducting material or a charge-generating agent for the electrophotosensitive material, and those disazo pigments having a variety of chemical structures have been proposed in, for example, Japanese Patent Publication Laid-Open No. 37453/1972, Japanese Patent Publication No. 63902/1988 and Japanese Patent Publication Laid-Open No. 39159/1990.

Disazo pigments exhibit excellent properties when they are used as charge-generating agents. However, there has not yet been provided a photosensitive material using disazo pigment which exhibits recurring property to a satisfactory degree. This is because, NOx and 03 are generated in the step of charging in the electrophotographic processing, and the azo pigment is deteriorated or decomposed being attacked by them. It has therefore been desired to develop a disazo pigment that withstands attacks by them.

In the field of electrophotographic copying, furthermore, it has been urged to develop a charge-generating agent which has a high sensitivity or a large charge-generating efficiency to meet the demand for increasing the copying speed.

SUMMARY OF THE INVENTION

It is therefore an object of the present invention to provide an electrophotosensitive material containing a charge-generating agent which is chemically stable exhibiting excellent recurring property and excellent charge-generating efficiency.

According to the present invention, there is provided an electrophotosensitive material containing, as a charge-generating agent, a compound represented by the following general formula (1),

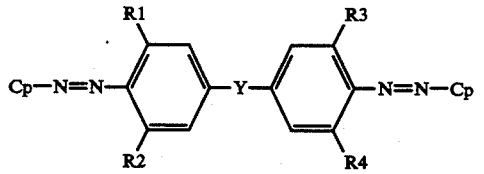

(1)

wherein Cp is an azo coupling component, Y is a divalent organic group containing at least one aromatic ring or heterocyclic ring, R1 and R3 are alkyl groups or halogen atoms, respectively, and R2 and R4 are alkyl groups, halogen atoms or hydrogen atoms, respectively.

DETAILED DESCRIPTION OF THE INVENTION

According to the present invention, the feature resides in that the electrophotosensitive material contains a novel disazo pigment represented by the aforementioned general formula (1) as a charge-generating agent.

The disazo pigment comprises a disazo component and an azo coupling component coupled thereto, and a distinguished feature resides in that a substituent of an alkyl group or a halogen atom is attached to the ortho-position of a benzene ring to which the azo group is coupled.

Though the disazo pigments used as charge-generating agents for the electrophotosensitive materials exhibit a variety of excellent properties, the conventional electrophotosensitive materials using disazo pigments still have the defect of poor recurring property. This is because, with the disazo pigment, the electrons are deflected toward the portion of the azo group (—N=N—), and this portion is subject to be attacked by NOx or the like that generate during the charging. Moreover, the electrons tend to be deflected toward the portion where the azo group is coupled to the aromatic ring and toward the neighboring ortho-position permitting attacks by NOx and ozone. These reasons are attributable to the decomposition of the disazo pigment. The decomposition of the disazo pigment due to the repetition of charging and exposure can in practice be confirmed from the fading of color of the pigment.

With the disazo pigment used in the present invention, a substituent is introduced to the ortho-position relative to the azo group in order to protect the azo group from the foreign matter relying upon the steric hindrance and, besides, the deviation in the electron density is eliminated by the introduction of the substituent, making it possible to improve chemical stability of the disazo pigment and to strikingly improve recurring property of the electrophotosensitive material.

For example, when a substituent is introduced into the m-position of the benzen ring to which an azo group is bonded, the stereoregularity in the central portion of this compound becomes very remarkable, and the planness of the bisazo molecular structure of this compound is lowered. As a result, the extent of a electron within a molecule is impaired, and the reduction of sensitivity is involved.

In addition, owing to the use of the disazo pigment of the above general formula (1), the electrophotosensitive material of the present invention presents an advantage of a high charge-generating efficiency. The charge-generating efficiency stands for the efficiency of generating electric charge on the basis of light quantum incident upon the photosensitive material. If mentioned in detail, it stands for a value measured in compliance With a method described below.

The charge-generating efficiency of the charge-generating agent is measured in compliance with "Transit Photoconductive Measuring Method" disclosed in a literature "Z. D. Popvic, J. Appl. Phys., 52, 6197, 1981".

Preparation of a Material to be Measured

Figure 1:
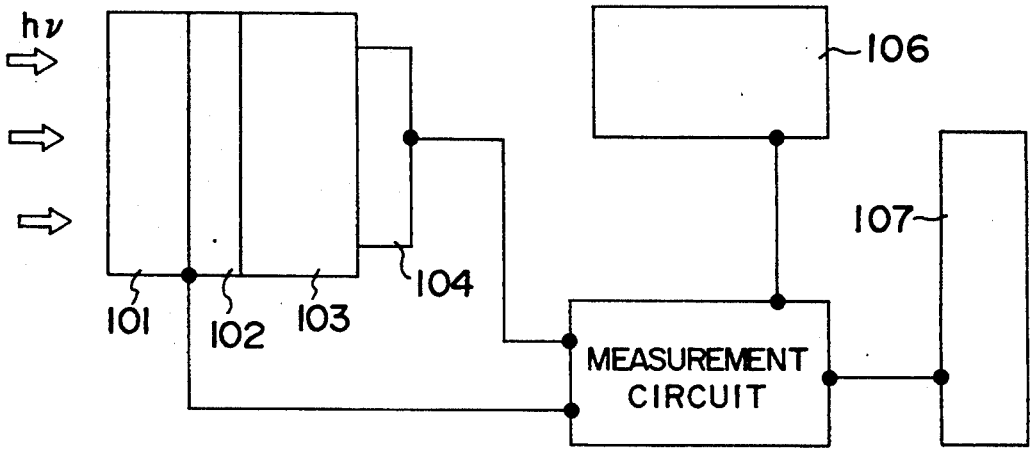
FIG. 1 is a block diagram of an apparatus used for the measurement of charge-generating efficiency.

With reference to FIG. 1, an ITO is vaporized onto a transparent polypropylene sheet 101 to form an electrode layer 102 on which is then formed a pigment-resin dispersion layer 103 maintaining a thickness of 5 microns. Gold is vaporized on the pigment-resin dispersion layer 103 to form an opposing electrode 104. A sandwich-type sample for measuring electric conductivity is thus obtained.

The samples used for the measurement are prepared under the following conditions. That is, Resin: polyester resin (Vilon 200 manufactured by Toyobo Co.) 90% by weight, Pigment: disazo compound 10% by weight, are homogeneously dispersed at the above ratio.

Measurement

Figure 2:
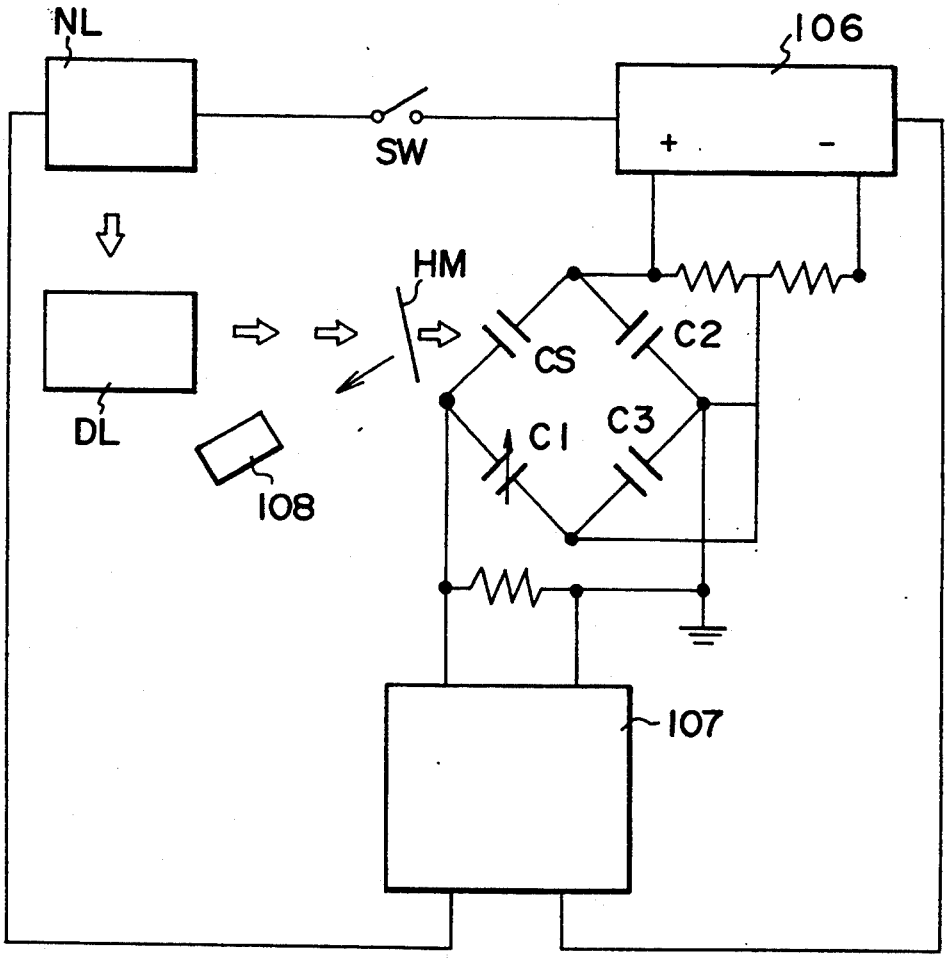
FIG. 2 is a diagram illustrating a major portion of the electronic circuit used for the apparatus of FIG. 1.

By using a laser beam as a source of light for exciting the sample, a pulse light is imparted to the transparent sheet 101 as shown in FIG. 1. The irradiation of light makes it possible to measure a voltage drop through the pigment-resin dispersion layer 103 that is sandwiched by the ITO electrode 102 and the metal electrode 104. In taking the measurement, the amount of displacement from the parallel state is measured by using a bridge circuit that is shown in FIG. 2.

If the circuit is described in detail, a bridge circuit is formed consisting of a total of four capacitors in which the sample to be measured is equalized to one of the capacitors, and the individual capacitors are measured for their changes in the voltage. That is, the sample CS to be measured and the other capacitors C1, C2 and C3 are measured. To take a measurement in practice, the switch SW is turned on, whereby a predetermined operation voltage is applied to a nitrogen gas laser NL from a power source 106 to energize the nitrogen gas laser NL, and a coloring matter laser DL is irradiated with the laser beam. The sample CS is then irradiated with a pulse of visible light from the coloring matter laser DL. A half-mirror HM is provided in an optical path between the color matter laser DL and the sample CS to be measured, and the light energy irradiated from the color matter laser is monitored by a monitor 108. The voltage drop through the sample CS due to the light irradiated from the coloring matter laser DL is measured by using a storage scope 107.

The measurement is taken by using the following devices:

Power source: TR300C manufactured by Advantest Co.

Nitrogen gas laser NL: LN300 manufactured by Nippon Laser Co.

Coloring matter laser DL: LD2S manufactured by Nippon Laser Co.

Monitor: Joulemeter manufactured by Molectron Co.

Storage scope: TS8123 manufactured by Iwatsu Co.

The charge-generating efficiency ($\eta$) is calculated from the measured value (voltage drop $\Delta V$) in compliance with the following equations (A) and (B).

$$\eta=(C\cdot\Delta V/eN\phi)\cdot(1/fv\cdot f(\epsilon_1, \epsilon_2)) \quad (A)$$

wherein a correction coefficient f ($\epsilon_1$, $\epsilon_2$) is calculated from the following equation (B).

$$f(\epsilon_1, \epsilon_2)=\epsilon_2/[\epsilon_1+2\epsilon_2-fv\cdot(\epsilon_1-\epsilon_2)] \quad (B)$$

wherein, C is an electrostatic capacitance of the sample, e is an amount of electric charge, $N\phi$ is a number of photons absorbed, $\epsilon_1$ is a dielectric constant of the pigment, fv is a volume percentage of the pigment, and $\epsilon_2$ is a dielectric constant of the resin.

The disazo pigments have little difference in structure and, hence, all have $\epsilon_1=4.45$.

The polyester resin has a dielectric constant $\epsilon_2=2.60$.

The volume percentage is 7.25 when the ratio of the pigment is 10% by weight.

The sample has a dielectric constant of 2.71 and the electrostatic capacitance at this moment is $C=4.8\times10^{-10}$.

The number of incident photons is $N\phi=5\times10^{-10}$.

The intensity of electric field across the electrodes is $3\times10^{7}$ V/m.

In this case, the samples exhibit the charge-generating efficiencies $\eta$ as shown in Tables 6, 7 and 8 appearing later in the working examples.

It will be recognized from Tables 6, 7 and 8 that the disazo pigments used in the present invention exhibit high charge-generating efficiencies. The reason is presumed to be that the azo component has a substituent of an alkyl or a halogen atom attached to the ortho-position of the azo group and that the skeltone of the azo component has many electron couplings.

Disazo Pigment

In the aforementioned general formula (1) representing a disazo pigment used in the present invention, each of the substituents R1 and R3 may be an alkyl group with 6 or less carbon atoms and, particularly, a methyl group, an ethyl group, an n- or isopropyl group, an n-, iso- or tert-butyl group, chlorine atom or bromine atom. Each of the groups R2 and R4 may be a hydrogen atom in addition to being the above-mentioned alkyl group or halogen atom. It is desired that R2 and R4 are alkyl groups or halogen atoms.

Divalent Organic Group Y

The divalent organic group Y in the general formula (1) includes at least one aromatic ring or heterocyclic ring. Described below are the concrete examples.

(I) Those represented by the following formulas (2) to (4),

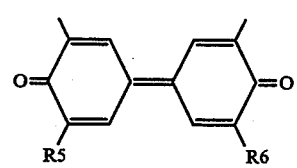

(2)

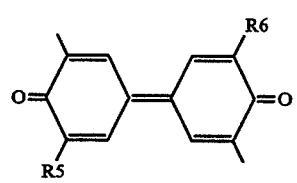

(3)

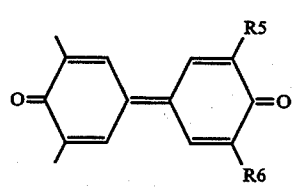

(4)

wherein R5 and R6 are alkyl groups, alkoxy groups or hydrogen atoms, respectively.

Here, the alkyl group should have 6 or less carbon atoms as described above, and the alkoxy group will be a methoxy group, an ethoxy group, a propoxy group, or a butoxy group having carbon atoms in a number of 6 or less.

(II) The one represented by the following formula (5),

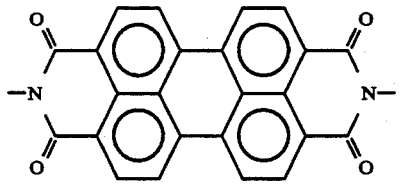

(5)

(III) The one represented by the following formula (6),

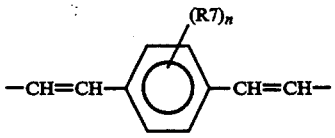

(6)

wherein R7 is an alkyl group, an alkoxy group or a hydrogen atom, and n is a number of 1 to 4.

Here, the alkyl group and the alkoxy group will be those exemplified in the above formulas (1) to (3).

(IV) The one represented by the following formula (7),

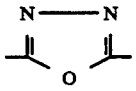

(7)

(V) The one represented by the following formula (8),

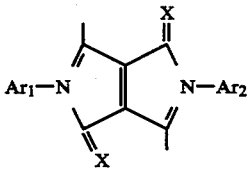

(8)

wherein X is an oxygen atom or a sulfur atom, and $Ar_1$ and $Ar_2$ are, respectively, alkyl groups, alkoxy groups, hydrogen atoms, or substituted or unsubstituted aryl groups.

Here, the alkyl group and the alkoxy group will be those which are exemplified above. Moreover, the aryl group will be a phenyl group, a tolyl group, a xylyl group, or a naphthyl group having 6 to 16 carbon atoms. In these groups, furthermore, the hydrogen atom may have been substituted by a halogen atom or a like atom.

Azo Coupling Component Cp

The azo coupling component Cp in the general formula (1) may be any one that has been widely known. A suitable example will be the following group.

(i) That is, the one represented by the following formula (9),

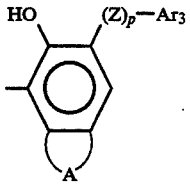

(9)

wherein Z is a CONH or an SO2NH group, p is 1 or 2, $Ar_3$ is a substituted or unsubstituted aryl group, and A denotes one or more condensed rings. Here, the aryl group may be those denoted by $Ar_1$ and $Ar_2$ in FIG. (8).

Described below are concrete examples of the azo coupling component Cp represented by the formula (9).

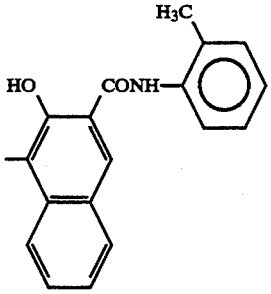

(9a)

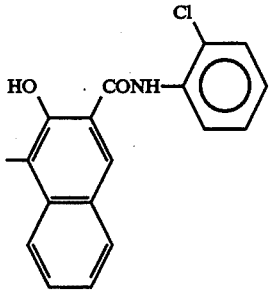

(9b)

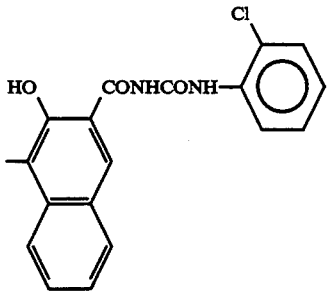

(9c)

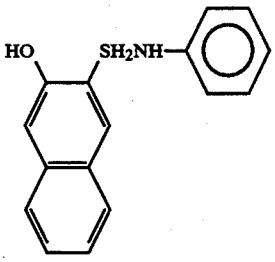

(9d)

-continued (9e)

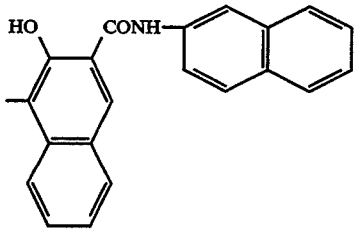

(9f)

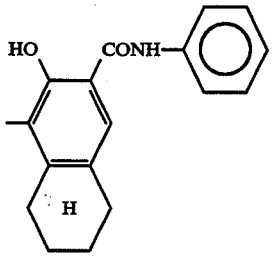

(9g)

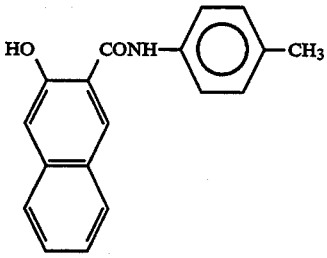

(9h)

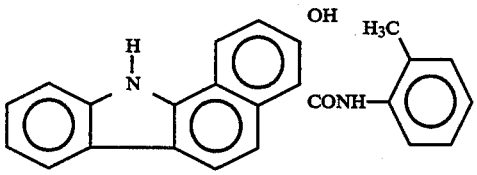

(ii) The one represented by the following formula (10), (10)

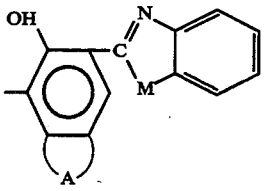

wherein A denotes one or more condensed rings which may be unsutstituted or substituted, and M is O, S or a —NH— group.

Described below are concrete examples of the azo coupling component Cp represented by the above formula (10).

(10a)

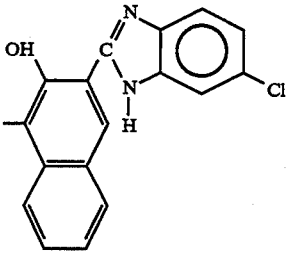

(10b)

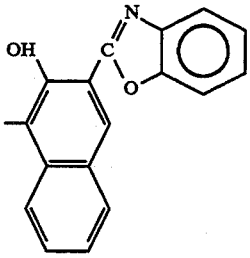

(10c)

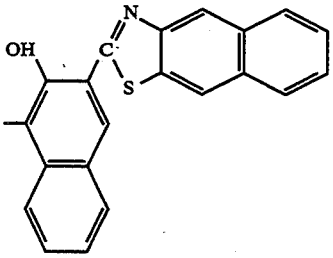

(10d)

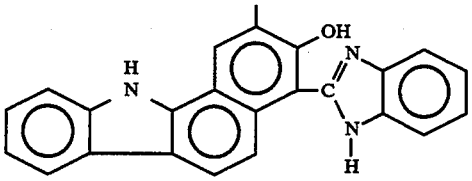

(iii) The one represented by the following formula (11) or (12), (11)

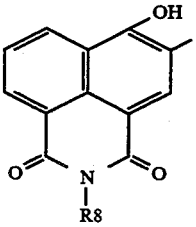

(12)

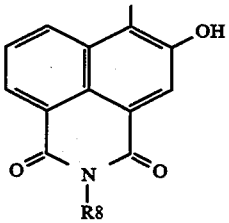

wherein R8 is a substituted or unsubstituted monovalent hydrocarbon group.

Here, the monovalent hydrocarbon group should have 1 to 16 carbon atoms. Its concrete examples include an alkyl group such as a methyl group, an ethyl group, a propyl group or a butyl group; an alkenyl group such as a vinyl group or an allyl group; a cycloalkyl group such as a cyclohexyl group; an aryl group such as a phenyl group, a tolyl group, a xylyl group or a naphthyl group; or an aralkyl group such as a benzyl group or a phenylethyl group. In these groups, the hydrogen atom may have been replaced by a methyl group or a halogen atom. Among them, preferred examples are the alkyl group, aryl group and aralkyl group.

Described below are concrete examples of the azo coupling component Cp represented by the above formula (11) or (12).

(11a)

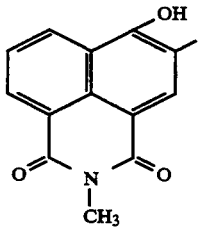

(11b)

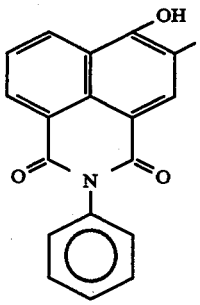

(11c)

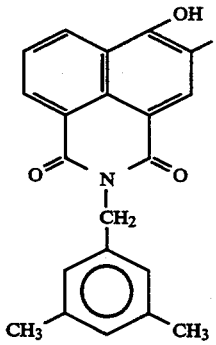

(11d)

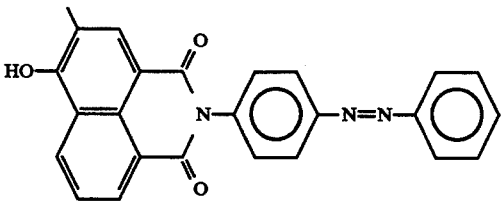

-continued (11e)

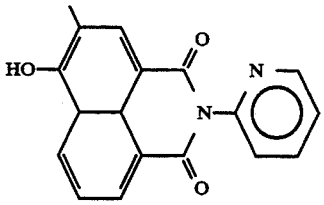

(11f)

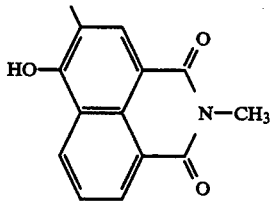

(iv) The one represented by the following formula (13) or (14), (13)

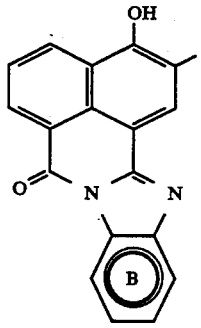

(14)

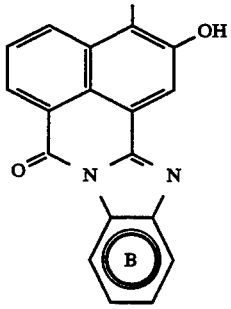

wherein the ring B may have a condensed ring which may be unsubstituted or substituted.

Described below are concrete examples of the azo coupling component Cp represented by the above formula (13) or (14).

(14a)

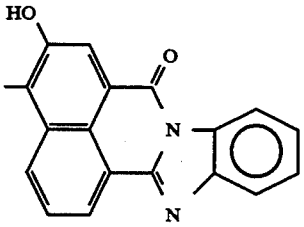

-continued (14b)

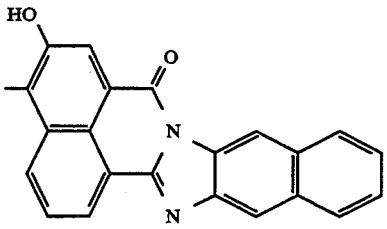

(14c)

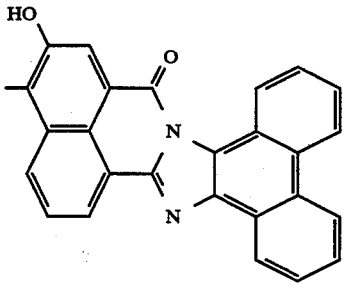

(14d)

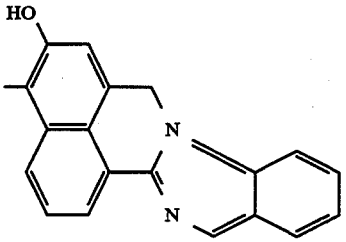

(13a)

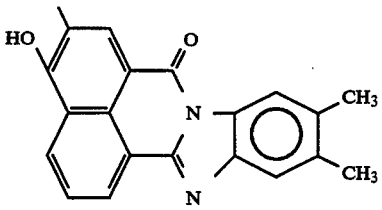

(13b)

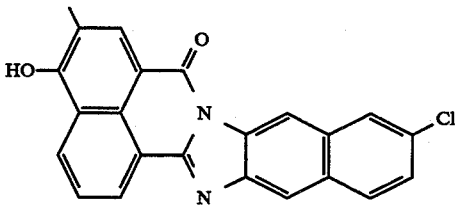

(v) The one represented by the formula (15), (15)

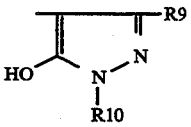

wherein R9 and R10 are substituted or unsubstituted monovalent hydrocarbon groups.

Here, the monovalent hydrocarbon group may be those exemplified for R8 in the above-mentioned formula (11) or (12). Described below are concrete examples of the azo coupling component Cp represented by the above formula (15).

(15a)

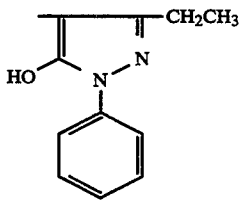

(15b)

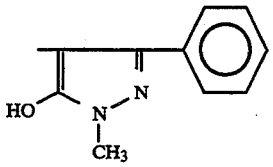

(15c)

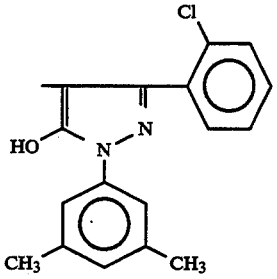

Preparation of Disazo Pigment

The disazo pigment represented by the above general formula (1) is obtained by acting a sodium nitride upon the corresponding amines which are represented by the following formula (1a);

(1a)

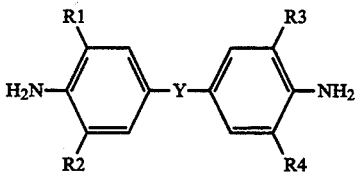

wherein R1, R2, R3, R4 and Y have the meanings as described above, in compliance with a customary method to form a tetrazonium salt thereof which is then coupled with an azo coupling component in a suitable solvent such as water or dimethylformamide in the presence of an alkali.

The diamine of the above formula (1a) is obtained by reacting corresponding halides represented by the following formula (1b);

(1b)

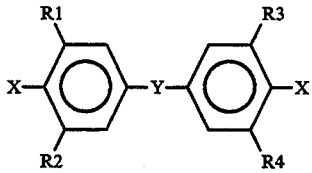

wherein X is a bromine or iodine atom, with the sodium amide ($NaNH_2$) in a solvent such as toluene or xylene. When any one of the groups R1, R2, R3 and R4 is a bromine atom, it is desired that X is an iodine atom.

Among the halides of the formula (1b), the compounds in which the group Y is as defined in the formula (2), (3) or (4), are obtained by oxidizing and dimerizing (diphenoquinotizing) the phenols of the following formula (1c);

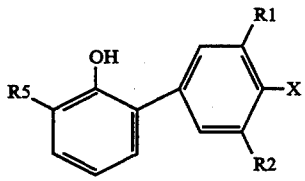

(1c)

in sulfuric acid in the presence of potassium dichromate, or are obtained by oxidizing and dimerizing (diphenoquinotizing) a mixture of the phenols of the following formula (1d);

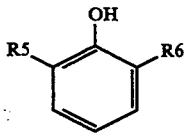

(1d)

and phenols of the following formula (1e);

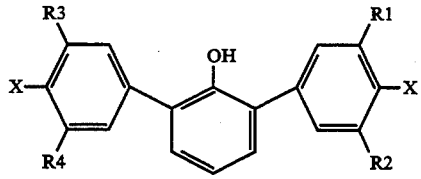

(1e)

in sulfuric acid in the presence of potassium dichromate. The reaction mixture obtained by the above reaction further contains the dimer of the formula (1d) and the dimer of the formula (1e), and is, hence, isolated and refined by utilizing the difference in solubility in the solvent.

Concrete Examples of Disazo Pigment

The compounds Nos. 1 to 74 shown in the following Tables 1, 2 and 3 are concrete examples of a particular disazo pigment of the present invention that has a substituent of an alkyl group or a halogen atom at the ortho-position of a benzene ring to which the azo group is coupled.

TABLE 1

| No. | R1 | R2 | R3 | R4 | Y | R5 | R6 | Cp |
|---|---|---|---|---|---|---|---|---|
| 1 | Me | H | Me | H | formula 2 | H | H | (9a) |
| 2 | Me | Me | Me | Me | formula 2 | Me | Me | (9b) |
| 3 | Et | Et | Et | Et | formula 2 | $CH_3O$— | $CH_3O$— | (9c) |
| 4 | iso-Pro | iso-Pro | Me | Me | formula 2 | Et | Et | (9h) |
| 5 | Me | Me | Me | Me | formula 2 | t-Bu | t-Bu | (10a) |
| 6 | t-Bu | t-Bu | Et | Et | formula 2 | H | Me | (10d) |
| 7 | Me | Et | Me | Et | formula 2 | $C_2H_5O$— | $C_2H_5O$— | (11a) |
| 8 | Cl | H | Cl | H | formula 2 | Me | Iso-Pro | (11c) |
| 9 | Br | H | Br | H | formula 2 | Et | t-Bu | (11e) |
| 10 | Cl | Cl | Me | Me | formula 2 | Me | $CH_3O$— | (14a) |
| 11 | Me | Me | Me | Me | formula 3 | Me | Me | (9g) |
| 12 | t-Bu | H | t-Bu | H | formula 3 | $CH_3O$— | $CH_3O$— | (10b) |
| 13 | Me | iso-Pro | Me | iso-Pro | formula 3 | t-Bu | t-Bu | (11b) |
| 14 | Cl | H | Cl | H | formula 3 | Me | t-Bu | (11d) |
| 15 | Br | Br | Br | Br | formula 3 | Et | $CH_3O$— | (11f) |
| 16 | Me | Cl | Me | Cl | formula 3 | H | $C_2H_5O$— | (14b) |
| 17 | Me | Me | Me | Me | formula 4 | Me | Me | (14d) |
| 18 | iso-Pro | H | Me | H | formula 4 | H | H | (15a) |
| 19 | Me | iso-Pro | Et | Et | formula 4 | Me | Et | (9d) |
| 20 | Me | t-Bu | Me | t-Bu | formula 4 | t-Bu | t-Bu | (10c) |
| 21 | Me | t-Bu | Et | iso-Pro | formula 4 | $CH_3O$— | $CH_3O$— | (14c) |
| 22 | Me | Me | Me | Et | formula 4 | Me | Me | (13a) |
| 23 | Me | t-Bu | Et | t-Bu | formula 4 | t-Bu | t-Bu | (13b) |
| 24 | Cl | Cl | Cl | Cl | formula 4 | $CH_3O$— | $CH_3O$— | (15b) |
| 25 | Me | Cl | Me | Br | formula 4 | Me | t-Bu | (16c) |

Ph: phenyl group, NaPh: naphthyl group, Me: methyl group, Et: ethyl group, Pro: propyl group, Bu: butyl group

TABLE 2

| No. | R1 | R2 | R3 | R4 | Y | R5 | n | Cp |
|---|---|---|---|---|---|---|---|---|
| 26 | Me | H | Me | H | formula 5 | | | (9h) |
| 27 | Me | Me | Me | Me | formula 5 | | | (11b) |
| 28 | Me | Me | t-Bu | t-Bu | formula 5 | | | (10a) |
| 29 | Me | iso-Pro | Me | iso-Pro | formula 5 | | | (9b) |
| 30 | Cl | H | Cl | H | formula 5 | | | (14a) |
| 31 | Me | Br | Me | Br | formula 5 | | | (11d) |
| 32 | Me | t-Bu | Et | iso-Pro | formula 5 | | | (15a) |
| 33 | Me | H | Me | H | formula 6 | | 0 | (10b) |
| 34 | Me | Me | Me | Me | formula 6 | Me | 1 | (9a) |
| 35 | Et | Et | Et | Et | formula 6 | $CH_3O$— | 1 | (11a) |
| 36 | Me | Me | iso-Pro | iso-Pro | formula 6 | 2-Me, 5-Me, | 2 | (11e) |
| 37 | Me | Me | t-Bu | t-Bu | formula 6 | | 0 | (14c) |
| 38 | Me | t-Bu | Me | t-Bu | formula 6 | | 0 | (13a) |
| 39 | Me | n-Pro | Et | Et | formula 6 | 2-Et, 5-Et | 2 | (15b) |
| 40 | Cl | Cl | Cl | Cl | formula 6 | 2-$CH_3O$, 5-$CH_3$ | 2 | (9d) |
| 41 | Br | H | Br | Br | formula 6 | 2-Me, 3-Me, 6-Me | 3 | (10c) |
| 42 | Cl | Cl | sec-Bu | sec-Bu | formula 6 | Me | 4 | (9f) |
| 43 | Me | H | Me | H | formula 7 | | | (9e) |
| 44 | Et | H | Et | H | formula 7 | | | (9h) |
| 45 | Me | H | t-Bu | H | formula 7 | | | (10d) |
| 46 | Me | t-Bu | Me | t-Bu | formula 7 | | | (11f) |

TABLE 2-continued

| No. | R1 | R2 | R3 | R4 | Y | R5 | n | Cp |
|---|---|---|---|---|---|---|---|---|
| 47 | Me | $isoC_5H_{11}$ | Me | $isoC_5H_{11}$ | formula 7 | | | (9c) |
| 48 | Cl | H | Cl | H | formula 7 | | | (11C) |
| 49 | Me | Cl | Me | Cl | formula 7 | | | (14b) |
| 50 | Me | Br | Et | Et | formula 7 | | | (14d) |

Ph: phenyl group, NaPh: naphthyl group, Me: methyl group, Et: ethyl group, Pro: propyl group, Bu: butyl group, n-Pro: normal Propyl group, sec-Bu: secondary butyl, 2-Me, 5-Me of e.g., No. 36: structures having Me at 2nd and 5th positions of the phenylene group (the same holds for Nos. 39,40,41).

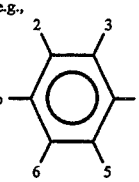

TABLE 3

| No. | R1 | R2 | R3 | R4 | Y | X | Ar1 | Ar2 | Cp |
|---|---|---|---|---|---|---|---|---|---|
| 51 | Me | t-Bu | Et | sec-Pro | formula 7 | | | | (15a) |
| 52 | Me | Me | Me | Me | formula 7 | | | | (14a) |
| 53 | Me | Me | Et | Et | formula 7 | | | | (9b) |
| 54 | Et | Et | Et | Et | formula 7 | | | | (9e) |
| 55 | Me | Me | Me | Me | formula 8 | oxygen | H | H | (9a) |
| 56 | Me | Me | Me | Me | formula 8 | oxygen | Me | Me | (9c) |
| 57 | Me | Me | Et | Et | formula 8 | oxygen | Ph | Ph | (10a) |
| 58 | Me | t-Bu | Me | t-Bu | formula 8 | oxygen | Et | Et | (9e) |
| 59 | Cl | H | Cl | H | formula 8 | oxygen | 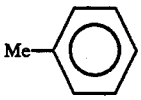 | 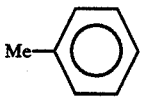 | (11a) |
| 60 | Me | Me | Br | Br | formula 8 | oxygen | H | Et | (10c) |
| 61 | Me | Et | Me | Et | formula 8 | oxygen | Me | Ph | (11e) |
| 62 | Me | H | Me | H | formula 8 | oxygen | H | H | (9h) |
| 63 | Et | H | Et | H | formula 8 | oxygen | H | H | (11b) |
| 64 | Me | Me | Et | Et | formula 8 | oxygen | Me | Me | (9d) |
| 65 | Me | H | Me | Ht | formula 8 | sulfur | H | H | (9b) |
| 66 | Me | Me | Me | H | formula 8 | sulfur | Me | Me | (9g) |
| 67 | Me | Et | Me | Et | formula 8 | sulfur | Ph | Ph | (9f) |
| 68 | Me | Me | Me | Me | formula 8 | sulfur | H | H | (11d) |
| 69 | Me | Me | Et | Et | formula 8 | sulfur | H | H | (14a) |
| 70 | Me | t-Bu | Me | t-Bu | formula 8 | sulfur | H | Me | (10a) |
| 71 | Me | sec-Bu | Et | Et | formula 8 | sulfur | 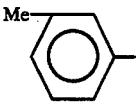 | 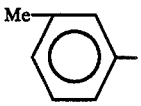 | (10b) |
| 72 | Cl | H | Cl | H | formula 8 | sulfur | Me | Et | (11c) |
| 73 | Me | Cl | Me | Cl | formula 8 | sulfur | t-Bu | t-Bu | (15a) |
| 74 | Et | Et | Br | Br | formula 8 | sulfur | H | H | (14b) |

Ph: phenyl group, NaPh: naphthyl group, Me: methyl group, Et: ethyl group, Pro: propyl group, Bu: butyl group Photosensitive Material The organic photosensitive material for electrophotography of the present invention may have any structure as far as it contains a particular disazo pigment in the photosensitive layer. The photosensitive material may be, for example, either of the single dispersion layer type or of the laminated type.

Figure 3:
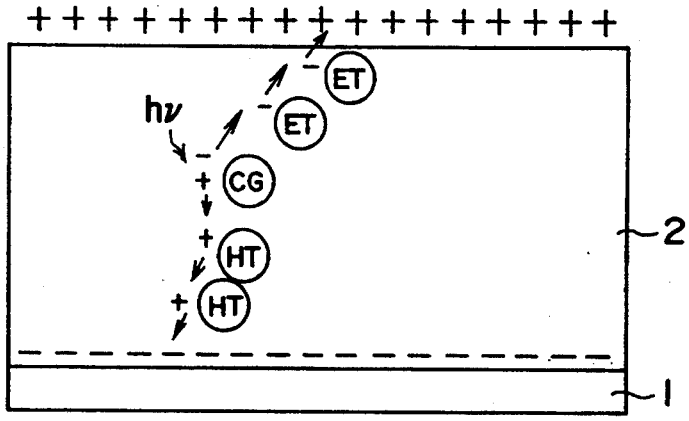
FIG. 3 is a diagram illustrating the principle for forming a charge image on a single layer dispersion-type photosensitive material of the present invention.

Referring to FIG. 3 which explains the principle for forming the charge image on the single layer dispersion-type photosensitive material of the present invention, an organic photosensitive layer 2 of the single layer dispersion type is formed on an electrically conducting substrate 1, and in the organic photosensitive layer 2 are dispersed a charge-generating agent CG composed of a particular disazo pigment and a charge-transporting agent (electron-transporting agent ET and/or hole-transporting agent HT). The surface of the organic photosensitive layer 2 is charged into, for example, the positive (+) polarity through the step of charging effected prior to the exposure, and the negative charge (−) is induced on the surface of the electrically conducting substrate. When irradiated with a ray of light (hν) under this condition, the charge-generating agent CG generates an electric charge; i.e., the electrons are injected into the electron-transporting agent ET, and migrate toward the surface of the organic photosensitive layer 2 to cancel the positive charge (+). On the other hand, the holes (+) are injected into the hole-transporting agent HT, migrate toward the surface of the electrically conducting substrate 1 without being trapped on the way, and are canceled by the negative charge (−) thereby to form a charge image.

Figure 4:
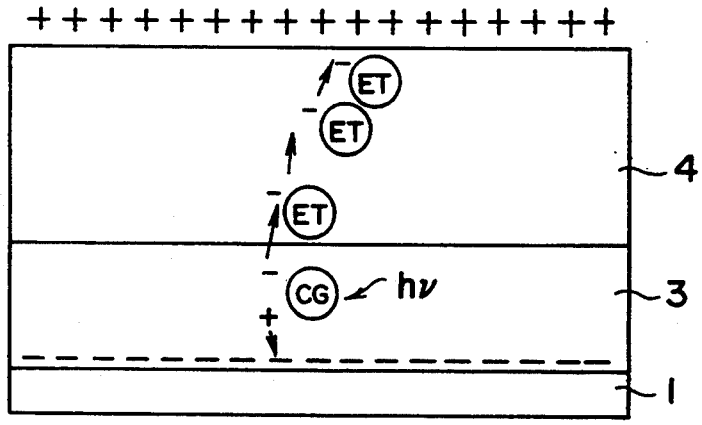
FIG. 4 is a diagram illustrating the principle for forming a charge image on a laminated layer-type photosensitive material of the present invention.

Referring to FIG. 4 which explains the principle for forming the charge image on the laminated photosensitive material of the present invention, a charge-generating layer 3 and a charge-transporting layer 4 are formed on the electrically conducting substrate 1 in the order mentioned. The charge-generating layer 3 contains a charge-generating agent CG composed of a particular disazo pigment, and in the charge-transporting layer 4 is dispersed, for example, the electron-transporting agent ET. The surface of the charge-transporting layer 4 is charged into, for example, the positive (+) polarity through the step of charging effected prior to the exposure, and the negative charge (−) is induced on the surface of the electrically conducting substrate. When irradiated with a ray of light (hν) under this condition, the charge-generating agent CG generates an electric charge; i.e., the electrons are injected into the electron-transporting agent ET, and migrate toward the surface of the charge-transporting layer 4 to cancel the positive charge (+). On the other hand, the holes (+) migrate toward the surface of the electrically conducting substrate 1 and are canceled by the negative charge (−) thereby to form a charge image.

Electrically Conducting Substrate

As the electrically conducting substrate, there can be used a variety of materials having electrically conducting property such as a single metal, e.g., aluminum, copper, tin, platinum, gold, silver, vanadium, molybdenum, chromium, cadmium, titanium, nickel, indium, stainless steel, brass or the like, or a plastic material on which is vaporized or laminated the above-mentioned metal, or a glass coated with aluminum iodide, tin oxide, indium oxide or the like.

In the case of the photosensitive material of the single layer dispersion type, there develops no interference fringe. Therefore, use is made of an ordinary aluminum tube and, particularly, a tube treated with Alumite such that the film thickness is from 1 to 50 μm. In the case of the laminated-type photosensitive material, there can be used an aluminum tube that is cut by a means which is known per se. such that there develops no interference fringe.

Charge-generating Agent

As the charge-generating agent, there is used a particular disazo pigment which has a steric hindrance group introduced into the ortho-position with respect to the azo group. The disazo pigment can be used alone or in a combination of two or more kinds. However, the disazo pigment having a diphenoquinone skeltone is particularly preferred. It is of course allowable to use the disazo pigment in combination with other charge-generating agents. Examples of the other charge-generating agents include, for example, selenium, selenium-tellurium, amorphous silicon, pyrylium salt, azo-type pigment, disazo-type pigment, anthanthrone-type pigment, phthalocyanine-type pigment, indigo-type pigment, threne-type pigment, toluidine-type pigment, pyrazoline-type pigment, perylene-type pigment, quinacridone-type pigment, and the like.

Single Layer Dispersion-type Photosensitive Material

A variety of resins can be used as a resin medium for dispersing the agents. Examples include olefin-type polymers such as a styrene-type polymer, an acrylic-type polymer, a styrene-acrylic-type polymer, an ethylene-vinyl acetate copolymer, a polypropylene, an ionomer, and the like; and photocuring-type resins such as a polyvinyl chloride, a vinyl chloride-vinyl acetate copolymer, a polyester, an alkyd resin, a polyamide, a polyurethane, an epoxy resin, a polycarbonate, a polyallylate, a polysulfone, a diallyl phthalate resin, a silicone resin, a ketone resin, a polyvinyl butylal resin, a polyether resin, a phenol resin, an epoxyacrylate and the like. These binder resins can be used in one kind or being mixed in two or more kinds. Preferred examples of the resin include a styrene-type polymer, an acrylic-type polymer, a stylene-acrylic-type polymer, a polyester, an alkid resin, a polycarbonate and a polyallylate.

In the photosensitive material of the single layer dispersion type, it is allowable to use a hole-transporting agent alone as the charge-transporting agent. Generally, however, an electron-transporting agent ET and a hole-transporting agent HT are used in combination.

Any hole-transporting material can be used as the hole-transporting agent, such as a nitrogen-containing cyclic compound, e.g., an oxadiazole-type compound, a styryl compound, a carbazole-type compound, an organopolysilane compound, a pyrazoline compound, a hydrazone compound, a triphenylamine-type compound, an indole-type compound, an oxazole-type compound, an isooxazole-type compound, a thiazole-type compound, a thiadiazole-type compound, an imidazole-type compound, a pyrazole-type compound, a triazole-type compound and the like, as well as those condensed polycyclic compounds having ionization potentials of from 5.0 to 6.0 eV. Particularly preferably, it is desired to use those compounds having a mobility of $10^{-6}$ $cm^2/Vsec$ or greater at a field intensity of $3\times10^5$ V/cm.

Though not necessarily limited thereto, preferred examples of the hole-transporting agent include:

a 1,1-bis(p-diethylaminophenyl-4,4 diphenyl-1,3 -butadiene;

an N,N'-bis(o,p-dimethylphenyl)-N,N'-diphenylbenzidine;

a 3,3'-dimethyl-N,N,N',N'-tetrakis-4-methylphenyl(1,1'-biphenyl)-4,4'-diamine;

an N-ethyl-3-carbazolylaldehyde-N,N'-diphenylhydrazone; and a 4-[N,N-bis(p-toluyl)amino]-β-phenylstilbene; and the like.

Any electron-transporting material can be used as the electron-transporting agent. Particularly preferred example is a diphenoquinone derivative having excellent electron-transporting property.

In the photosensitive material of the present invention, it is desired that the charge-generating agent composed of a particular disazo pigment is contained in the photosensitive layer in an amount of 0.05 to 30% by weight and, particularly, in an amount of 0.1 to 10% by weight per the solid component. Here, the hole-transporting agent may be used alone or being combined with the electron-transporting agent. When used alone, the hole-transporting agent should be used in an amount of 80 to 150% by weight and, particularly, in an amount of 50 to 120% by weight per the solid component. When used in combination, the electron-transporting agent ET such as a diphenoquinone derivative or the like should be contained in the photosensitive layer in an amount of 10 to 150% by weight and, particularly, in an amount of 80 to 120% by weight per the solid component, and the hole-transporting agent HT should be contained in the photosensitive layer in an amount of 10 to 150% by weight and, particularly, in an amount of 80 to 120% by weight per the solid components. Moreover, the ratio of ET:HT should be from 1:9 to 9:1 and, particularly, from 2:8 to 8:2 on the weight basis.

The composition for forming the photosensitive material of the present invention may be blended with a variety of blending agents which have been known per se., such as an antioxidizing agent, a radical-trapping agent a singlet state quencher, a UV-absorbing agent, a softening agent, a surface improving agent, an extinguishing agent, a filler, a sticking agent, a dispersion stabilizer, a wax, an acceptor, a donor, and the like in such amounts that do not adversely affect the electrophotographic properties.

According to the present invention, it was found that when the steric hindrance phenolic-type antioxidizing agent is blended in an amount of 0.1 to 50% by weight per the whole solid components, the photosensitive layer exhibits markedly improved durability without adversely affecting the electrophotographic properties.

As the solvent for forming the coating solution, there can be used a variety of organic solvents such as alcohols, i.e., methanol, ethanol, isopropanol, butanol and the like; aliphatic hydrocarbons, i.e., n-hexane, octane, cyclohexane and the like; aromatic hydrocarbons such as benzene, toluene, xylene and the like; halogenated hydrocarbons such as dichloromethane, dichloroethane, carbon tetrachloride, chlorobenzene and the like; ethers such as dimethyl ether, diethyl ether, tetrahydrofurane, ethylene glycol dimethyl ether, diethylene glycol dimethyl ether and the like; ketones such as acetone, methyl ethyl ketone, cyclohexanone and the like; esters such as ethyl acetate, methyl acetate and the like; dimethylformamide, dimethylsulfoxide, and the like, either in one kind or in a mixture of two or more kinds. The coating solution should generally have a solid component concentration of 5 to 50%.

In order to obtain the coating solution, the charge-generating material, the binder resin and the like are prepared relying upon a widely known method such as a roll mill, a ball mill, an attritor, a paint shaker or an ultrasonic dispersing device. The coating solution is then applied using a widely known coating means and is dried.

Though there is no particular limitation, the photosensitive layer should have a thickness of generally from 5 to 100 μm and, particularly, from 10 to 50 μm.

Laminated-type Photosensitive Material

The laminated-type photosensitive material is prepared in the same manner as described above with the exception of separately providing the charge-generating layer and the charge-transporting layer on the electrically conducting substrate. There can be used the above-mentioned binder resins in which will be dispersed the charge-generating agent and the charge-transporting agent.

The charge-generating agent layer may be provided by coating the binder resin in which has been dispersed the charge-generating agent or by such means as vacuum-evaporating or sputtering the charge-generating agent. In the former case, a widely known underlying layer or a barrier layer may be provided between the charge-generating layer and the substrate.

In the former case of the dispersion type, the charge-generating agent should be contained in an amount of 0.05 to 30% by weight and, particularly, in an amount of 0.1 to 10% by weight per the solid component in the photosensitive layer which should have a thickness of usually from 0.05 to 10 μm and, particularly, from 0.1 to 5 μm. In the latter case of the evaporation type, the thickness should be usually from 0.01 to 5 μm and, particularly, from 0.05 to 1 μm.

In the charge-transporting layer, the charge-transporting agent such as the amine derivative (HT) should be contained in an amount of 10 to 150% by weight and, particularly, in an amount of 30 to 120% by weight per the solid component. Moreover, the thickness thereof should usually range from 10 to 50 μm and, particularly, from 15 to 35 μm.

EXAMPLES

The invention will now be described by way of the following examples.

Examples 1 to 21, Comparative Examples 1 to 8 and 17 to 40

Laminated-type Photosensitive Material

100 Parts by weight of a charge-generating material, 100 parts by weight of the polyvinyl butyral as a binder resin, and a predetermined amount of the tetrahydrofurane were dispersed, and the thus obtained dispersion solution was applied onto an Alumite tube of a diameter of 78 mm by the immersion coating method, followed by drying to obtain a charge-generating layer having a thickness of 0.7 μm.

Onto the charge-generating layer was applied a solution having the following composition for forming the charge-transporting layer by the immersion coating method, followed by drying at 100° C. for one hour to form the charge-transporting layer, thereby to obtain a 25 μm-thick laminated electrophotosensitive material of the negatively charged type.

| (Composition) | |
|---|---|
| Charge-transporting material [N,N,N',N'-tetrakis-(3-methylphenyl)-1,3-diaminobenzine | 100 parts by weight |
| Binder resin [bisphenol A-type polycarbonate] | 100 parts by weight |
| Dichloromethane | predetermined amount |

Examples have employed the charge-generating materials of the aforementioned compounds and Comparative Examples have employed the compounds of the following Tables 4 to 12, as listed in Tables 13, 15, 16 and 17.

TABLE 4
| No | Structure of core portion | Cp |
|---|---|---|
| B1 | 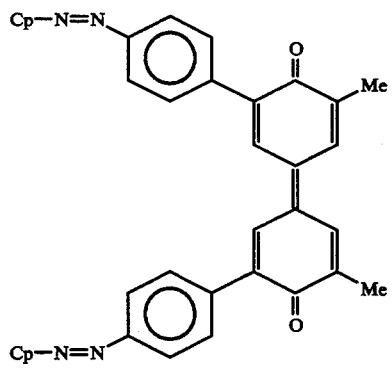 | (9b) |
| B2 | 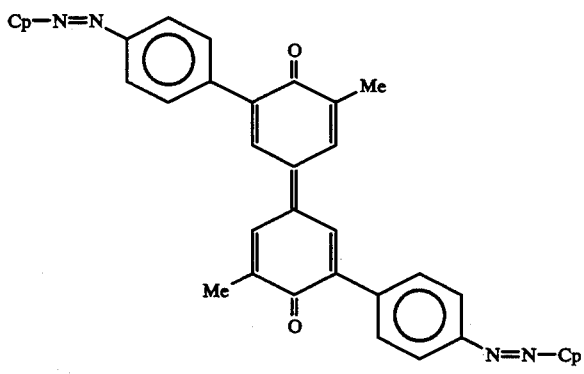 | (9g) |
| B3 | 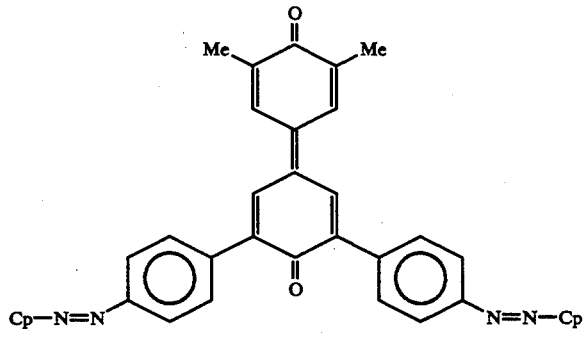 | (14d) |
| B4 | 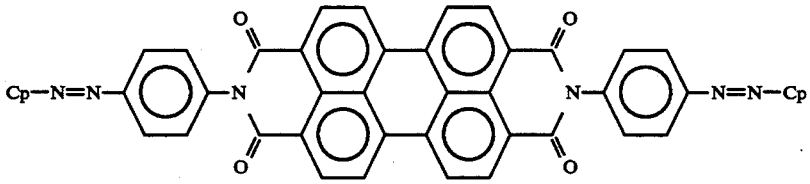 | (9h) |
| B5 | 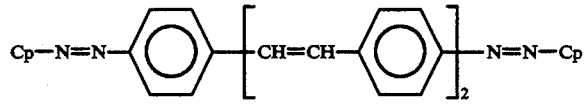 | (9a) |
TABLE 5
| No | Structure of core portion | Cp |
|---|---|---|
| B6 | 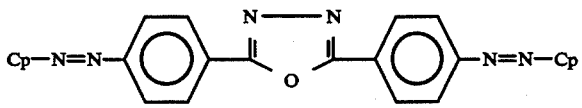 | (9h) |

TABLE 5-continued
| No | Structure of core portion | Cp |
|---|---|---|
| B7 | 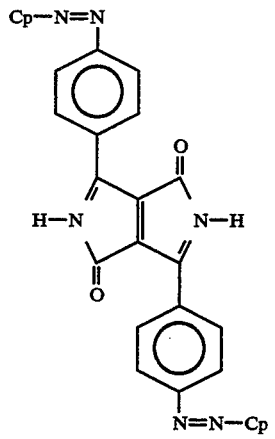 | (9a) |
| B8 | 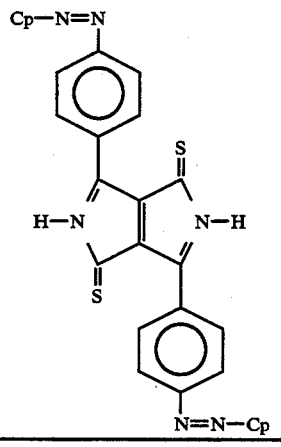 | (9b) |
TABLE 6
| No. | Structure of core portion | Cp |
|---|---|---|
| B9 | 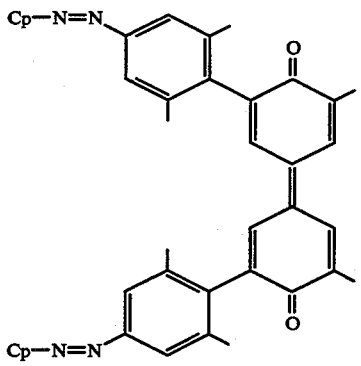 | (9b) |
TABLE 6-continued
| No. | Structure of core portion | Cp |
|---|---|---|
| B10 | 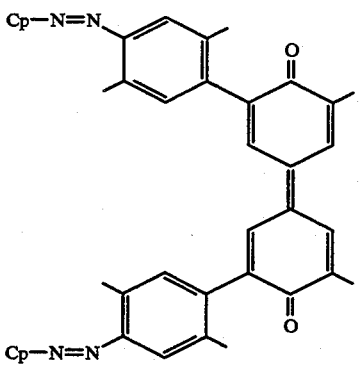 | (9b) |

TABLE 6-continued
| No. | Structure of core portion | Cp |
|---|---|---|
| B11 | 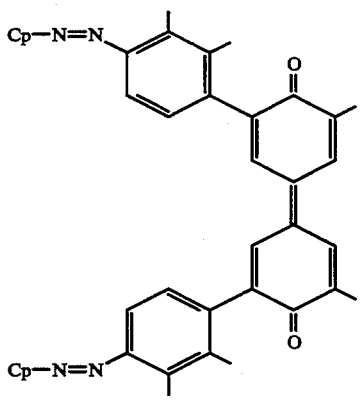 | (9b) |
TABLE 7
| No. | Structure of core portion | Cp |
|---|---|---|
| B12 | 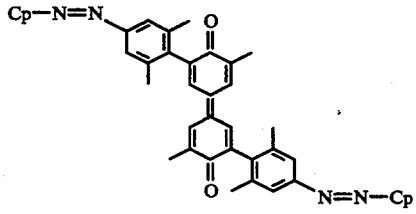 | (9g) |
| B13 | 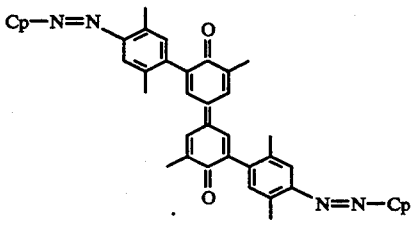 | (9g) |
TABLE 7-continued
| No. | Structure of core portion | Cp |
|---|---|---|
| B14 | 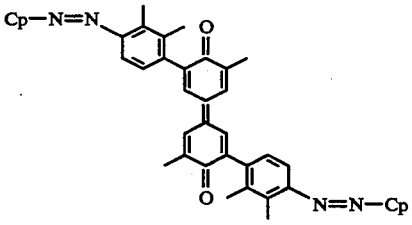 | (9g) |
TABLE 8
| No. | Structure of core portion | Cp |
|---|---|---|
| B15 | 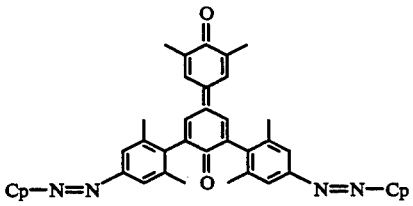 | (14d) |
| B16 | 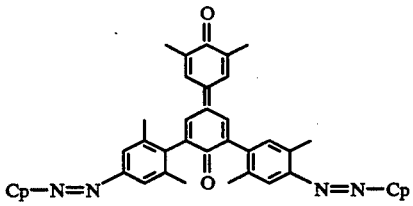 | (14d) |
| B17 | 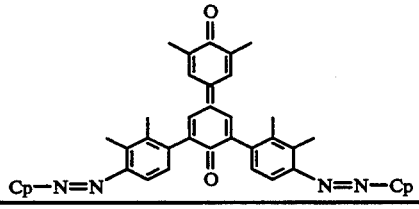 | (14d) |
TABLE 9
| No. | Structure of core portion | Cp |
|---|---|---|
| B18 | 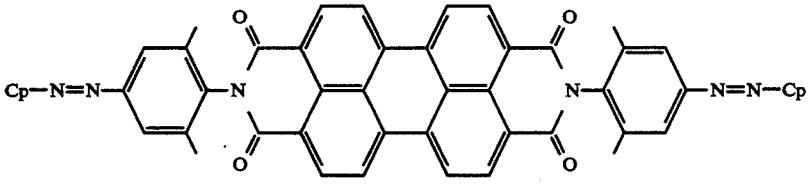 | (9h) |
| B19 | 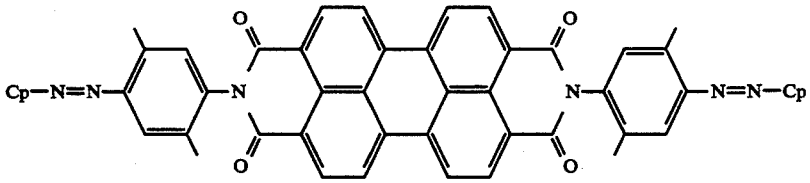 | (9h) |
| B20 | 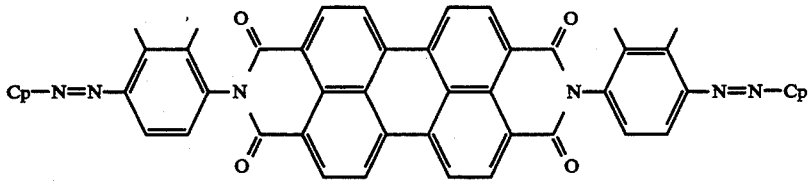 | (9h) |

TABLE 9-continued
| No. | Structure of core portion | Cp |
|---|---|---|
| B21 | 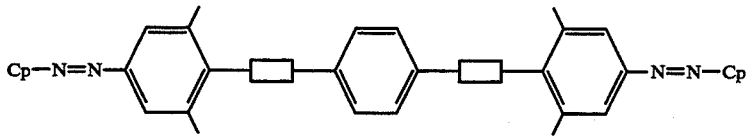 | (9a) |
| B22 | 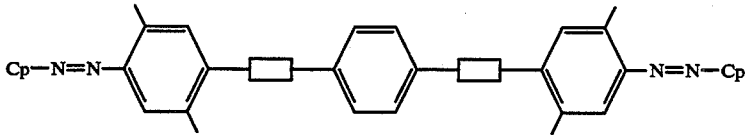 | (9a) |
| B23 | 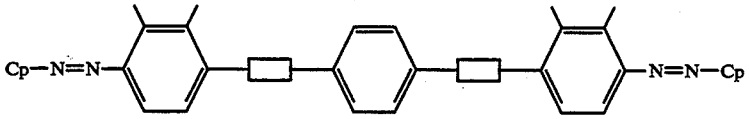 | (9a) |
TABLE 10
| No. | Structure of core portion | Cp |
|---|---|---|
| B24 | 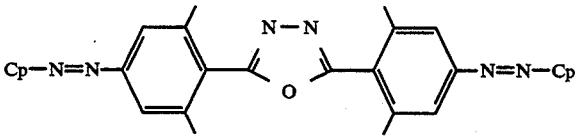 | (9h) |
| B25 | 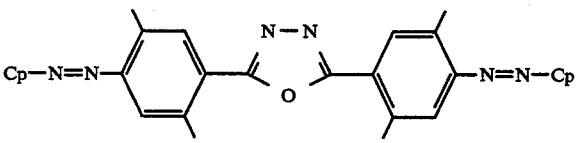 | (9h) |
| B26 | 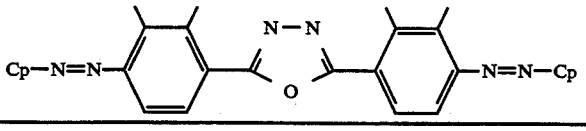 | (9h) |
TABLE 11
| No. | Structure of core portion | Cp |
|---|---|---|
| B27 | 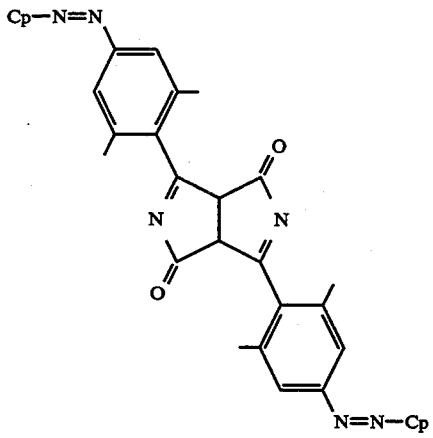 | (9a) |
TABLE 11-continued
| No. | Structure of core portion | Cp |
|---|---|---|
| B28 | 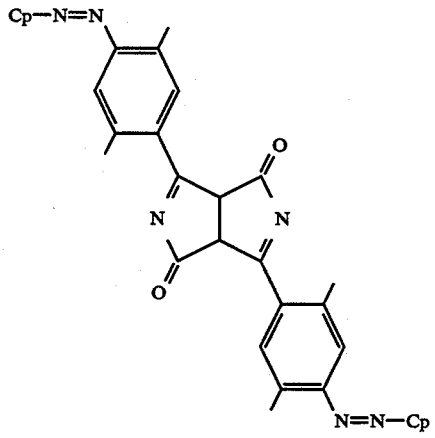 | (9a) |

TABLE 11-continued

| No. | Structure of core portion | Cp |
|---|---|---|
| B29 | 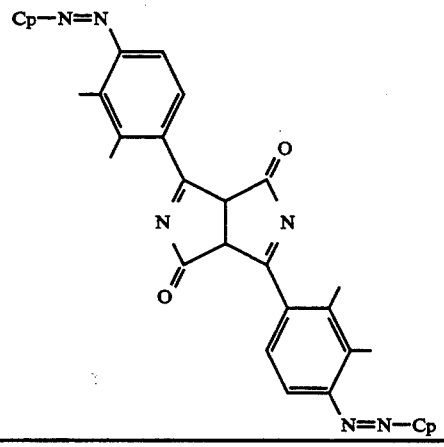 | (9a) |

TABLE 12

| No. | Structure of core portion | Cp |
|---|---|---|
| B30 | 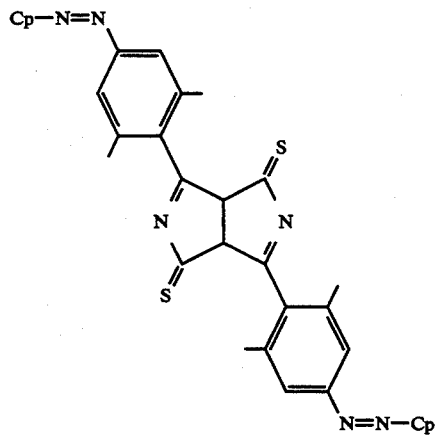 | (9b) |
| B31 | 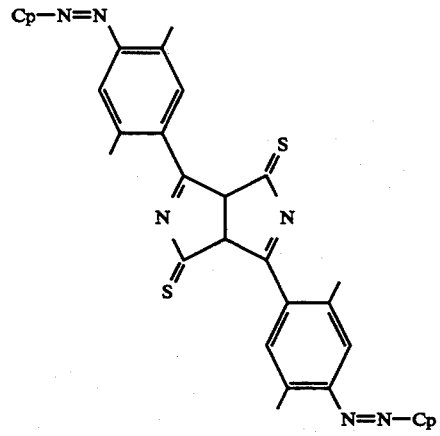 | (9b) |

TABLE 12-continued

| No. | Structure of core portion | Cp |
|---|---|---|
| B32 | 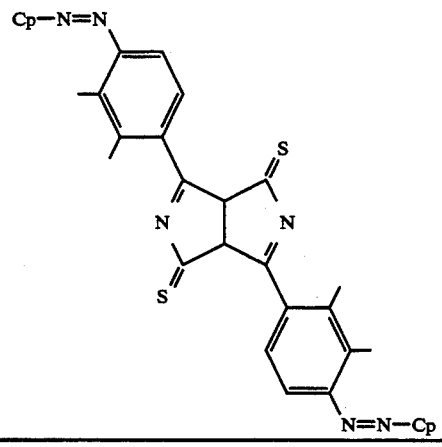 | (9b) |

Examples 22 to 42, Comparative Examples 9 to 16 and 41 to 64

Single-layer Photosensitive Material

10 Parts by weight of a charge-generating material, 100 parts by weight of an N,N,N',N'-tetrakis(3-methylphenyl)-1,3-diaminobenzine as a charge-transporting material, 100 parts by weight of a bisphenol A-type polycarbonate as a binder resin, and a predetermined amount of dichloromethane were dispersed to prepare a coating solution for forming a single-layer photosensitive material. The coating solution was applied onto the Alumite tube having a diameter of 78 mm by the immersion coating method, followed by drying at 100° C. for one hour to obtain a 25 μm-thick single-layer photosensitive material of the positively charged type.

The aforementioned compounds were used as the charge-generating materials as listed in Tables 14, 15, 17 and 18.

The electrophotosensitive materials obtained in the above Examples and Comparative Examples were subjected to the following test to evaluate their properties.

Electric Properties

Measured by using a drum;sensitivity tester.

Charging Property Vo

The laminated photosensitive material is charged into the negative polarity and the single-layer photosensitive material is charged into the positive polarity. When charged with a predetermined corona voltage (6.5 kV), the initial surface potential is denoted by Vo. Residual potential VR, Half exposure quantity $E_{\frac{1}{2}}$.

A halogen lamp is used as the source of light to produce white light, light intensity is 10 luxes, and the time of light irradiation is 10 seconds. The charging condition (flow-in current) is so adjusted that the initial surface potential is about 800 V, and a curve of potential attenuation is measured after irradiated with light. The sensitivity was evaluated as follows:

Potential 5 seconds after irradiation with light is denoted by VR.

The time when the initial surface potential decreases to one-half (400 V) after irradiation with light is regarded to be half exposure time, and half exposure time×light intensity is denoted by $E_{\frac{1}{2}}$.

Recurring Stability

Mounted on the Mita DC-1670M (modified into a charging polarity variable type) and after the charge-exposure was repeated about 10,000 times, a change ΔVo in the surface potential, a change ΔVR in the sensitivity and $E_{\frac{1}{2}}$ were evaluated (here, however, the flow-in current of when the recurring stability is measured is the same as when the initial characteristics are measured). The results were as shown in Tables 13 to 18.

TABLE 13

| | CGM No. | Charge-generating efficiency (%) | Initial VO | Initial VR | Initial $E_{\frac{1}{2}}$ lux · sec | Δ VO | Δ $E_{\frac{1}{2}}$ lux · sec | Δ VR |
|---|---|---|---|---|---|---|---|---|
| Example 1 | 1 | 8.3 | −815 | −36 | 0.71 | −25 | −0.1 | +5 |
| Example 2 | 2 | 9.7 | −780 | −34 | 0.60 | −10 | +0.1 | 0 |
| Example 3 | 8 | 4.8 | −830 | −38 | 1.12 | −15 | +0.1 | +5 |
| Example 4 | 11 | 7.9 | −770 | −43 | 0.73 | +5 | −0.1 | −5 |
| Example 5 | 12 | 6.2 | −815 | −40 | 0.90 | −10 | ±0 | −10 |
| Example 6 | 19 | 7.6 | −765 | −44 | 0.71 | −20 | −0.1 | −5 |
| Example 7 | 23 | 8.8 | −770 | −31 | 0.68 | −15 | ±0 | −5 |
| Example 8 | 28 | 5.1 | −745 | −30 | 1.37 | −30 | ±0 | +10 |
| Example 9 | 29 | 6.4 | −805 | −34 | 1.34 | −20 | +0.1 | ±0 |
| Example 10 | 32 | 3.9 | −760 | −32 | 1.30 | −35 | −0.1 | −10 |
| Example 11 | 34 | 7.7 | −800 | −40 | 0.76 | −30 | +0.1 | +10 |
| Example 12 | 39 | 5.1 | −790 | −45 | 1.10 | −20 | +0.1 | +15 |
| Example 13 | 42 | 6.3 | −805 | −48 | 1.01 | −30 | ±0 | +10 |
| Example 14 | 43 | 7.2 | −760 | −49 | 0.81 | −25 | +0.1 | +5 |
| Example 15 | 45 | 6.8 | −776 | −52 | 0.83 | −10 | −0.1 | −5 |
| Example 16 | 50 | 7.8 | −790 | −50 | 0.76 | −20 | +0.1 | +5 |
| Example 17 | 55 | 5.5 | −820 | −52 | 1.06 | −20 | +0.1 | −5 |
| Example 18 | 61 | 5.9 | −740 | −54 | 1.12 | −30 | +0.1 | ±0 |
| Example 19 | 65 | 6.6 | −720 | −35 | 0.82 | −10 | −0.1 | +10 |
| Example 20 | 68 | 6.3 | −730 | −39 | 0.81 | −15 | −0.1 | −10 |
| Example 21 | 74 | 7.2 | −805 | −51 | 0.77 | −20 | −0.1 | +5 |

CGM: charge-generating material

TABLE 14

| | CGM No. | Charge-generating efficiency (%) | Initial VO | Initial VR | Initial $E_{\frac{1}{2}}$ lux · sec | Δ VO | Δ $E_{\frac{1}{2}}$ lux · sec | Δ VR |
|---|---|---|---|---|---|---|---|---|
| Example 22 | 1 | 8.3 | +800 | +30 | 0.66 | −50 | +0.1 | ±0 |
| Example 23 | 2 | 9.7 | +805 | +30 | 0.68 | −30 | ±0 | −5 |
| Example 24 | 8 | 4.8 | +810 | +33 | 1.07 | −20 | +0.1 | +10 |
| Example 25 | 11 | 7.9 | +760 | +35 | 0.68 | +10 | −0.1 | −10 |
| Example 26 | 12 | 6.2 | +840 | +38 | 0.87 | ±0 | −0.1 | −15 |
| Example 27 | 19 | 7.6 | +805 | +34 | 0.66 | −30 | −0.2 | −20 |
| Example 28 | 23 | 8.8 | +795 | +28 | 0.62 | −20 | +0.1 | +10 |
| Example 29 | 28 | 5.1 | +775 | +27 | 1.23 | −40 | +0.1 | +15 |
| Example 30 | 29 | 6.4 | +820 | +25 | 1.19 | −35 | −0.1 | −5 |
| Example 31 | 32 | 3.9 | +780 | +28 | 1.40 | −20 | −0.1 | −15 |
| Example 32 | 34 | 7.7 | +830 | +62 | 0.80 | −70 | +0.2 | +20 |
| Example 33 | 39 | 5.1 | +810 | +66 | 1.23 | −40 | +0.1 | +25 |
| Example 34 | 42 | 6.3 | +790 | +70 | 1.10 | −65 | ±0.1 | +5 |
| Example 35 | 43 | 7.2 | +780 | +54 | 0.85 | −70 | +0.1 | −10 |
| Example 36 | 45 | 6.8 | +765 | +59 | 0.88 | −30 | −0.2 | +5 |
| Example 37 | 50 | 7.8 | +815 | +55 | 0.81 | −30 | +0.2 | +20 |
| Example 38 | 55 | 5.5 | +830 | +58 | 1.11 | −50 | ±0 | +10 |
| Example 39 | 61 | 5.9 | +765 | +63 | 1.16 | −40 | +0.1 | −5 |
| Example 40 | 65 | 6.6 | +760 | +42 | 0.92 | −20 | −0.2 | +10 |
| Example 41 | 68 | 6.3 | +790 | +48 | 0.96 | −30 | ±0 | −20 |
| Example 42 | 74 | 7.2 | +830 | +57 | 0.83 | −40 | +0.1 | +10 |

CGM: charge-generating material

TABLE 15

| | CGM No. | Charge-generating efficiency (%) | Initial VO | Initial VR | Initial $E_{\frac{1}{2}}$ lux · sec | Δ VO | Δ $E_{\frac{1}{2}}$ lux · sec | Δ VR |
|---|---|---|---|---|---|---|---|---|
| Comparative Example 1 | B1 | 8.5 | −780 | −36 | 0.67 | −30 | +0.1 | +15 |
| Comparative Example 2 | B2 | 6.9 | −795 | −39 | 0.82 | −50 | +0.1 | +10 |
| Comparative Example 3 | B3 | 9.1 | −830 | −34 | 0.62 | −40 | +0.2 | +20 |
| Comparative Example 4 | B4 | 4.3 | −770 | −29 | 1.41 | −45 | −0.2 | +30 |
| Comparative Example 5 | B5 | 5.1 | −810 | −40 | 1.04 | −45 | +0.3 | +35 |
| Comparative Example 6 | B6 | 7.6 | −835 | −46 | 0.73 | −40 | +0.2 | +35 |

TABLE 15-continued

| | CGM No. | Charge-generating efficiency (%) | Initial VO | Initial VR | Initial $E_{\frac{1}{2}}$ lux · sec | Δ VO | Δ $E_{\frac{1}{2}}$ lux · sec | Δ VR |
|---|---|---|---|---|---|---|---|---|
| Comparative Example 7 | B7 | 5.4 | −710 | −41 | 1.03 | −70 | +0.1 | +40 |
| Comparative Example 8 | B8 | 6.7 | −730 | −40 | 0.88 | −50 | +0.1 | +30 |
| Comparative Example 9 | B1 | 8.5 | +810 | +25 | 0.63 | −80 | +0.3 | +25 |
| Comparative Example 10 | B2 | 6.9 | +790 | +29 | 0.77 | −95 | +0.2 | +25 |
| Comparative Example 11 | B3 | 9.1 | +815 | +27 | 0.58 | −90 | +0.3 | +30 |
| Comparative Example 12 | B4 | 4.3 | +750 | +22 | 1.27 | −80 | +0.2 | +25 |
| Comparative Example 13 | B5 | 5.1 | +790 | +62 | 1.12 | −150 | +0.4 | +60 |
| Comparative Example 14 | B6 | 7.9 | +830 | +64 | 0.75 | −130 | +0.3 | +55 |
| Comparative Example 15 | B7 | 5.4 | +720 | +54 | 1.11 | −110 | +0.2 | +75 |
| Comparative Example 16 | B8 | 6.7 | +720 | +47 | 0.90 | −115 | +0.2 | +50 |

CGM: charge-generating material

TABLE 16

| | Structure No. | Charge-generating efficiency (%) | Initial VO | Initial VR | Initial $E_{\frac{1}{2}}$ lux · sec | Δ VO | Δ $E_{\frac{1}{2}}$ lux · sec | Δ VR |
|---|---|---|---|---|---|---|---|---|
| Comparative Example 17 | B9 | 7.4 | −785 | −48 | 0.71 | −35 | +0.2 | +20 |
| Comparative Example 18 | B10 | 8.1 | −803 | −40 | 0.69 | −40 | +0.1 | +15 |
| Comparative Example 19 | B11 | 6.3 | −810 | −53 | 0.83 | −25 | +0.1 | +20 |
| Comparative Example 20 | B12 | 6.2 | −791 | −44 | 0.75 | −50 | +0.1 | +25 |
| Comparative Example 21 | B13 | 6.6 | −808 | −42 | 0.78 | −45 | +0.2 | +20 |
| Comparative Example 22 | B14 | 6.3 | −784 | −65 | 0.83 | −55 | +0.1 | +20 |
| Comparative Example 23 | B15 | 8.8 | −795 | −38 | 0.64 | −45 | +0.1 | +25 |
| Comparative Example 24 | B16 | 8.6 | −807 | −36 | 0.63 | −40 | +0.2 | +20 |
| Comparative Example 25 | B17 | 8.1 | −813 | −42 | 0.67 | −40 | +0.2 | +20 |
| Comparative Example 26 | B18 | 3.0 | −790 | −68 | 1.56 | −45 | +0.2 | +30 |
| Comparative Example 27 | B19 | 3.5 | −810 | −60 | 1.52 | −50 | +0.2 | +25 |
| Comparative Example 28 | B20 | 2.3 | −827 | −75 | 1.80 | −40 | +0.1 | +30 |
| Comparative Example 29 | B21 | 3.4 | −795 | −65 | 1.67 | −60 | +0.1 | +30 |
| Comparative Example 30 | B22 | 4.4 | −790 | −60 | 1.53 | −50 | +0.3 | +35 |
| Comparative Example 31 | B23 | 2.2 | −785 | −80 | 1.95 | −55 | +0.2 | +35 |
| Comparative Example 32 | B24 | 5.1 | −802 | −60 | 1.21 | −35 | +0.3 | +20 |
| Comparative Example 33 | B25 | 6.3 | −815 | −55 | 0.95 | −40 | +0.2 | +30 |
| Comparative Example 34 | B26 | 3.0 | −812 | −60 | 1.64 | −40 | +0.1 | +45 |
| Comparative Example 35 | B27 | 4.9 | −825 | −46 | 1. 11 | −75 | +0.2 | +45 |
| Comparative Example 36 | B28 | 5.1 | −814 | −43 | 1.15 | −80 | +0.1 | +40 |

TABLE 17

| | Structure No. | Charge-generating efficiency (%) | Initial VO | Initial VR | Initial $E_{\frac{1}{2}}$ lux · sec | Δ VO | Δ $E_{\frac{1}{2}}$ lux · sec | Δ VR |
|---|---|---|---|---|---|---|---|---|
| Comparative Example 37 | B29 | 3.8 | −813 | −53 | 1.24 | −85 | +0.1 | +40 |
| Comparative Example 38 | B30 | 5.4 | −796 | −56 | 1.13 | −65 | +0.1 | +47 |
| Comparative Example 39 | B31 | 6.2 | −789 | −51 | 1.20 | −55 | +0.1 | +55 |
| Comparative Example 40 | B32 | 5.1 | −803 | −62 | 1.19 | −60 | +0.2 | +50 |
| Comparative Example 41 | B9 | 7.4 | +815 | +32 | 0.71 | −85 | +0.2 | +30 |
| Comparative Example 42 | B10 | 8.1 | +809 | +28 | 0.69 | −100 | +0.3 | +25 |
| Comparative Example 43 | B11 | 6.3 | +822 | +40 | 0.73 | −80 | +0.3 | +30 |
| Comparative Example 44 | B12 | 6.2 | +828 | +36 | 0.71 | −90 | +0.2 | +30 |
| Comparative Example 45 | B13 | 6.6 | +796 | +32 | 0.68 | −120 | +0.2 | +25 |
| Comparative Example 46 | B14 | 6.3 | +811 | +40 | 0.75 | −105 | +0.3 | +25 |
| Comparative Example 47 | B15 | 8.8 | +823 | +31 | 0.76 | −95 | +0.2 | +35 |
| Comparative Example 48 | B16 | 8.6 | +785 | +30 | 0.81 | −115 | +0.3 | +30 |
| Comparative Example 49 | B17 | 8.1 | +794 | +38 | 0.82 | −110 | +0.2 | +25 |
| Comparative Example 50 | B18 | 3.0 | +830 | +43 | 1.36 | −80 | +0.3 | +35 |
| Comparative Example 51 | B19 | 3.5 | +806 | +45 | 1.32 | −75 | +0.3 | +30 |
| Comparative Example 52 | B20 | 2.3 | +784 | +63 | 1.44 | −90 | +0.3 | +55 |
| Comparative Example 53 | B21 | 3.4 | +791 | +78 | 1.32 | −145 | +0.4 | +65 |
| Comparative Example 54 | B22 | 4.4 | +786 | +72 | 1.36 | −180 | +0.4 | +60 |
| Comparative Example 55 | B23 | 2.2 | +820 | +84 | 1.80 | −165 | +0.3 | +50 |
| Comparative Example 56 | B24 | 5.1 | +822 | +74 | 0.98 | −140 | +0.3 | +50 |

TABLE 18

| | Structure No. | Charge-generating efficiency (%) | Initial VO | Initial VR | Initial $E_{\frac{1}{2}}$ lux · sec | Δ VO | Δ $E_{\frac{1}{2}}$ lux · sec | Δ VR |
|---|---|---|---|---|---|---|---|---|
| Comparative Example 57 | B25 | 6.3 | +816 | +69 | 0.82 | −165 | +0.3 | +55 |
| Comparative Example 58 | B26 | 3.0 | +827 | +81 | 1.25 | −155 | +0.4 | +50 |
| Comparative Example 59 | B27 | 4.9 | +784 | +63 | 1.24 | −135 | +0.3 | +70 |
| Comparative Example 60 | B28 | 5.1 | +794 | +56 | 1.10 | −145 | +0.3 | +70 |
| Comparative Example 61 | B29 | 3.8 | +811 | +77 | 1.25 | −150 | +0.2 | +65 |
| Comparative Example 62 | B30 | 5.4 | +824 | +61 | 1.03 | −155 | +0.2 | +50 |
| Comparative Example 63 | B31 | 6.2 | +789 | +55 | 0.96 | −170 | +0.3 | +45 |
| Comparative Example 64 | B32 | 5.1 | +806 | +74 | 1.01 | −165 | +0.2 | +55 |

As will be obvious from Tables 13 to 18, the electrophotosensitive materials of Examples 1, 2 and of the present invention exhibited excellent charging property, residual potential, half exposure quantity and recurring property. In the case of Comparative Example 1, 17, 18 and 19 which has the core portion of the charge-generating material same as that of Examples 1, 2 and 3 but without having a substituent of alkyl or halogen atom at the ortho-position of the benzene ring to which the azo group is coupled, on the other hand, the charging property deteriorated extremely after the repetitive use, and the half exposure quantity and the residual potential were poor.

Described below are Comparative Examples having core portions of the charge-generating materials whose structures are the same as those of the corresponding Examples but without having substituent of alkyl or halogen atom at the ortho-position of benzene ring to which the azo group is coupled.

Examples 4, 5 and Comparative Example 2, 20, 21 and 22
Examples 6, 7 and Comparative Example 3, 23, 24 and 25
Examples 8, 9, 10 and Comparative Example 4, 26, 27 and 28
Examples 11, 12, 13 and Comparative Example 5, 29, 30 and 31
Examples 14, 15, 16 and Comparative Example 6, 32, 33 and 34
Examples 17, 18 and Comparative Example 7, 35, 36 and 37
Examples 19, 20, 21 and Comparative Example 8, 38, 39 and 40
Examples 22, 23, 24 and Comparative Example 9, 41, 42 and 43
Examples 25, 26 and Comparative Example 10, 44, 45 and 46
Examples 27, 28 and Comparative Example 11, 47, 48 and 49
Examples 29, 30, 31 and Comparative Example 12, 50, 51 and 52
Examples 32, 33, 34 and Comparative Examples 13, 53, 54 and 55
Examples 35, 36, 37 and Comparative Example 14, 56, 57 and 58
Examples 38, 39 and Comparative Example 15, 59, 60 and 61
Examples 40, 41, 42 and Comparative Example 16, 62, 63 and 64.

We claim:

1. An electrophotosensitive material containing, as a charge-generating agent, a compound represented by the following general formula (1)

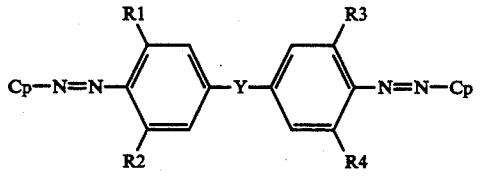

(1)

wherein

Cp is an azo coupling component,

R1 and R3 are alkyl groups or halogen atoms, respectively,

R2 and R4 are alkyl groups, halogen atoms or hydrogen atoms, respectively,

Y is a divalent organic group selected from the group consisting of

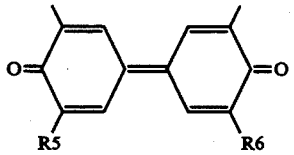

(2)

wherein R5 and R6 are alkyl groups, alkoxy groups or hydrogen atoms, respectively,

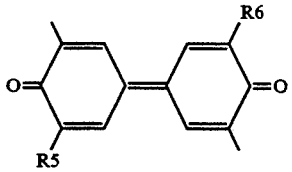

(3)

wherein R5 and R6 are alkyl groups, alkoxy groups or hydrogen atoms, respectively,

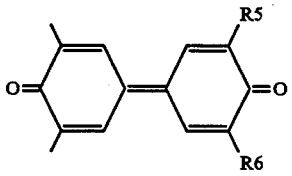

(4)

wherein R5 and R6 are alkyl groups, alkoxy groups or hydrogen atoms, respectively,

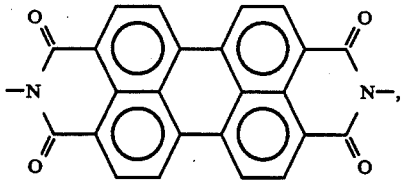

(5)

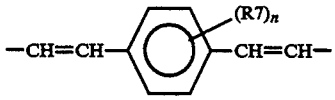

(6)

wherein R7 is an alkyl group, an alkoxy group or a hydrogen atom, and n is a number of 1 to 4,

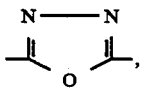

(7)

and

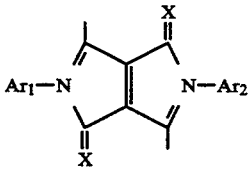

(8)

wherein X is an oxygen atom or a sulfur atom, and $Ar_1$ and $Ar_2$ are alkyl group, alkoxy groups, hydrogen atoms and substituted or unsubstituted aryl groups, respectively.

2. An electrophotosensitive material according to claim 1, wherein the azo coupling component Cp is a group represented by the formula (9),

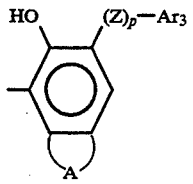

(9)

wherein Z is a CONH or a $SO_2NH$ group, p is 1 or 2, $Ar_3$ is a substituted or unsubstituted aryl group, and A denotes one or more condensed rings.

3. An electrophotosensitive material according to claim 1, wherein the azo coupling component Cp is a group represented by the formula (10),

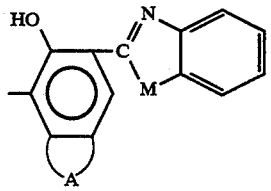

(10)

wherein A denotes one or more condensed rings which may be unsubstituted or substituted, and M denotes O, S or a —NH— group.

4. An electrophotosensitive material according to claim 1, wherein the azo coupling component Cp is a group represented by the formula (11) or (12),

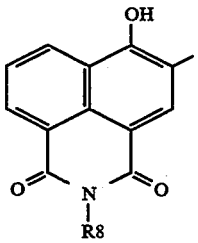

(11)

-continued

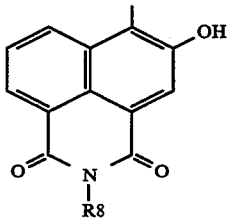

(12)

wherein R8 is a substituted or unsubstituted monovalent hydrocarbon group.

5. An electrophotosensitive material according to claim 1, wherein the azo coupling component Cp is a group represented by the formula (13) or (14),

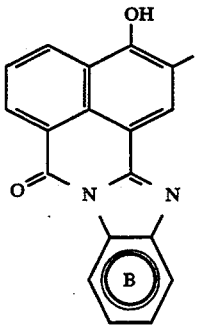

(13)

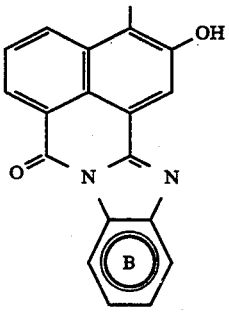

(14)

wherein the ring B may have a condensed ring which may be unsubstituted or substituted.

6. An electrophotosensitive material according to claim 1, wherein the azo coupling component Cp is a group represented by the formula (15),

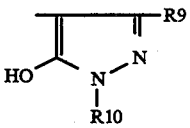

(15)

wherein R9 and R10 are substituted or unsubstituted monovalent hydrocarbon groups, respectively.

* * * * *